United States Patent [19]

Flammann

[11] Patent Number: 4,580,477

[45] Date of Patent: Apr. 8, 1986

[54] ADJUSTABLE HOUSEHOLD SLICING MACHINE

[75] Inventor: Norbert Flammann, Solingen, Fed. Rep. of Germany

[73] Assignee: Robert Krups Stiftung & Co. KG, Solingen, Fed. Rep. of Germany

[21] Appl. No.: 664,976

[22] Filed: Oct. 26, 1984

[30] Foreign Application Priority Data

Nov. 14, 1983 [DE] Fed. Rep. of Germany ..... 3341180

[51] Int. Cl.[4] ..... B26D 7/22

[52] U.S. Cl. ..... 83/707; 83/467 R; 83/400

[58] Field of Search ..... 83/707, 713–731, 83/467, 468, 700

[56] References Cited

U.S. PATENT DOCUMENTS 4,273,013 6/1981 Artin et al. ..... 83/707 X

*Primary Examiner*—James M. Meister

*Attorney, Agent, or Firm*—Peter K. Kontler

[57] ABSTRACT

A household slicing machine wherein a rotary disc-shaped knife is mounted in a housing in a vertical plane to slice foodstuffs which abut against the front side of a stop. The front side of the stop is located in a second vertical plane which is parallel to the plane of the knife and the machine has an adjusting device which can move the stop relative to the knife so as to shift the plane of the front side of the stop nearer to or further away from the plane of the knife and to thereby select the thickness of the slices which are severed from the selected foodstuff. The adjusting device has a stationary component having a follower whose carrier is removably mounted in a working platform which forms part of the housing and is located in front of the stop. The carrier extends through a window of the stop into a helical path which is defined by two confronting cylindrical walls respectively forming part of an inner and an outer sleeve. These sleeves form part of a rotary component of the adjusting device which is mounted on a shaft extending from the rear side of the stop and further having a cap which is snapped onto the outer sleeve and serves to rotate the sleeves when the operator wishes to change the distance between the plane of the front side of the stop and the plane of the knife.

30 Claims, 18 Drawing Figures

FIG.13
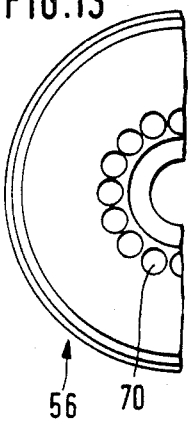
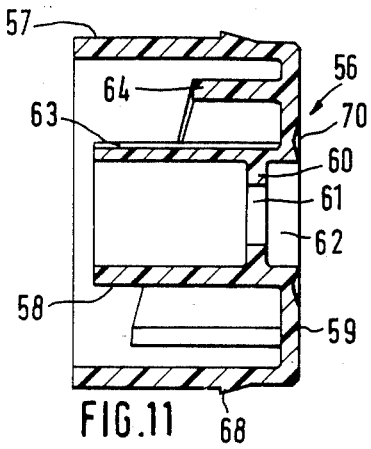
FIG.11
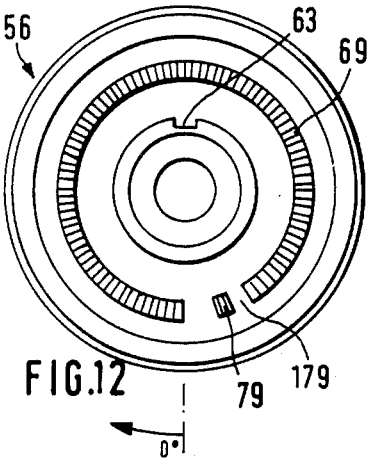
FIG.12
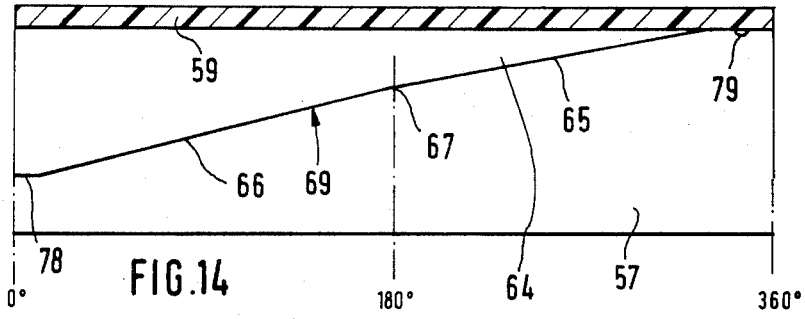
FIG.14
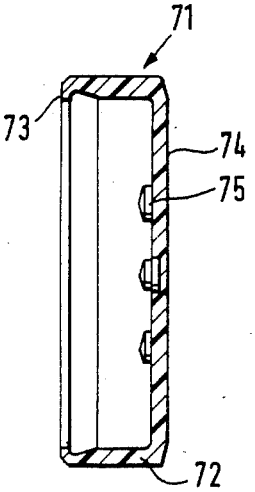
FIG.15
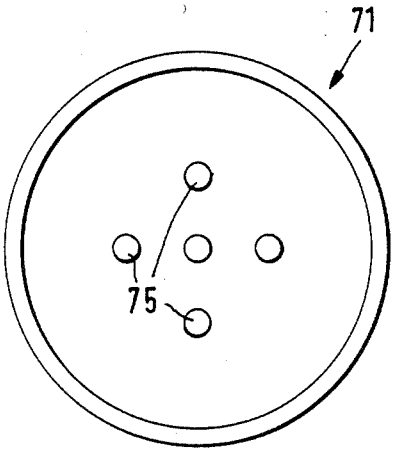
FIG.16

ADJUSTABLE HOUSEHOLD SLICING MACHINE

CROSS-REFERENCE TO RELATED CASES

The appliance which is disclosed in the present application is or can be identical with the appliance described and shown in the commonly owned copending patent application Ser. No. 665,366 filed Oct. 26, 1984 by Stefan Henn et al. for "Adjustable slicing machine for bread and other types of foodstuffs". Furthermore, the appliance which is disclosed in the present application is similar to the appliance which is described and shown in the commonly owned copending patent application Ser. No. 665,128 filed Oct. 26, 1984 by Norbert Flammann for "Household appliance with an adjustable guard for a rotary tool" and in the commonly owned copending patent application Ser. No. 665,017 filed Oct. 26, 1984 by Norbert Flammann et al. for "Household appliance and an adjustable guard for its tool".

BACKGROUND OF THE INVENTION

The present invention relates to appliances in general, and more particularly to improvements in household appliances of the type wherein a rotary knife is used to slice bread or other foodstuffs. Still more particularly, the invention relates to improvements in appliances of the type wherein the thickness of slices can be varied by changing the position of a stop for foodstuffs with reference to the plane of the knife.

As a rule, the means for adjusting the position of the stop with reference to the knife comprises a nut which is secured to a stationary part of the housing of the appliance and a feed screw which is rotatably mounted on the stop and meshes with the nut. It is also known to employ a fixedly mounted feed screw which meshes with a rotatable nut. In most instances, the feed screw is a metallic part which must be adequately anchored in the stop or in the housing, especially if the stop or housing is made of a different material (e.g., a synthetic plastic substance). Moreover, the material of the metallic feed screw is likely to rust, especially if the appliance is used for the slicing of foodstuffs containing certain types of acids. Still further, the versatility of appliances using such adjusting devices is rather low.

OBJECTS AND SUMMARY OF THE INVENTION

An object of the invention is to provide an appliance wherein the device for adjusting the position of the stop relative to the knife is constructed in a novel and improved way.

Another object of the invention is to provide a novel and improved adjusting device for the mobile stop of a household slicing machine.

A further object of the invention is to provide an adjusting device which contributes to greater versatility of the appliance.

An additional object of the invention is to provide an adjusting device which consists of simple and inexpensive parts, whose parts can be mass-produced in available machines, and whose parts can be assembled or taken apart with little loss in time.

Still another object of the invention is to provide a novel and improved stop for use in an appliance of the above outlined character.

A further object of the invention is to provide the appliance with an adjusting device which allows for a much wider range of selection of the thickness of slices than the heretofore known appliances.

Another object of the invention is to provide the adjusting device with a novel and improved component which replaces a conventional feed screw and with a novel and improved component which replaces a conventional nut.

The improved appliance can constitute a household slicing machine and comprises a support, a knife which is mounted in the support for rotation in a first plane (e.g., in a vertical plane), and a stop for the material to be sliced. The stop is located in a second plane which is at least substantially parallel to the first plane and the appliance further comprises adjusting means which is mounted in part on the support and in part on the stop and serves to move the stop in a direction transversely of (i.e., at right angles to) the first plane. The adjusting means comprises a first component having two coaxial sleeves respectively including first and second cylindrical walls respectively having first and second helical surfaces defining a helical path and a second component including a follower extending into the helical path so that the stop is moved relative to the first plane when one of the components is rotated about the common axis of the sleeves. The first component is preferably rotatable on a shaft of the stop and the second component is preferably fixedly mounted in the support. The sleeves preferably include an inner sleeve which comprises the first cylindrical wall and an outer sleeve which includes the second cylindrical wall and surrounds the inner sleeve. Retaining means (e.g., a split ring which is receivable in a circumferential groove of the aforementioned shaft) is preferably provided to hold the sleeves against axial movement relative to the shaft of the stop. The means for rotating the outer sleeve preferably comprises a cap which is detachably affixed to the outer sleeve and the first component then further comprises means for transmitting torque from the outer sleeve to the inner sleeve. Such torque transmitting means can comprise an axially parallel tongue provided on one of the sleeves and a groove which is provided in the other sleeve and receives the tongue.

The support can include a stationary working platform which is located in front of the stop and means for separably securing the first component of the adjusting means to the platform. The outer sleeve can be made of a single piece of synthetic plastic material and preferably further includes an outer cylindrical wall spacedly surrounding the second cylindrical wall and an inner cylindrical wall which is spacedly surrounded by the second cylindrical wall. Such outer sleeve preferably further comprises an end wall which is integral with the second cylindrical wall as well as with the inner and outer cylindrical walls and has a centrally located opening for the shaft of the stop. The outer side of the end wall of the outer sleeve can be provided with a centrally located pocket which receives the end portion of the shaft and the aforementioned retaining means for holding the sleeves against axial movement along the shaft in a direction away from the rear side of the stop.

The inner sleeve of the first component of the adjusting means is preferably a one-piece body made of a synthetic plastic material and further having an additional cylindrical wall which is coaxial and integral with the first cylindrical wall. The outer diameter of the additional cylindrical wall is different from the outer diameter of the first cylindrical wall and the first helical surface is disposed at one axial end of the additional cylindrical wall of the inner sleeve. The inner sleeve is preferably provided with internal ribs or other suitable means for centering it on the shaft of the stop. The first cylindrical wall of the inner sleeve can be provided with an axially parallel channel which communicates with a predetermined portion of the helical path and allows for separation of the first and second components from each other. All that is necessary is to move the follower into the predetermined portion of the helical path and to thereupon move one of the components relative to the other component in the axial direction of the shaft. The shaft extends from the rear side of the stop whose front side constitutes an abutment for the material to be sliced. A substantially ring-shaped receptacle is preferably provided at the rear side of the stop to rotatably receive the outer cylindrical wall of the outer sleeve. A washer-like centering member is preferably provided at the rear side of the stop and such member extends into the open end of the first cylindrical wall of the inner sleeve when the first component of the adjusting means is properly mounted on the shaft. A window is provided in the stop between the washer-like member and the receptacle (as considered in the radial direction of the shaft) for a carrier which is preferably integral with the follower and forms part of the second component of the adjusting means.

The stop preferably includes a plurality of elongated parallel guides which extend from its front side and are slidably received in suitable holes of the working platform. The second component of the adjusting means is preferably a one-piece body consisting of a synthetic plastic material and being installed in the working platform of the support. The carrier of the second component preferably includes a first portion having a central part and two wings extending laterally from opposite sides of the central part and having front end faces tapering toward the follower. Such carrier preferably further comprises an enlarged second or rear portion and the first portion is located between the follower and the second portion. The working platform is preferably formed with a recess facing toward the front side of the stop and at least partially receiving the second portion of the carrier. The means for separably securing the second portion of the carrier to the working platform can comprise a threaded member (e.g., a screw) which extends through a first wall of the working platform. The latter preferably includes a second wall which is adjacent to the first wall and has an opening for a centering stud on the second portion of the carrier. The securing means can extend through a hole provided in a centrally located partition of the preferably hollow second portion of the carrier.

As mentioned above, the first component can further comprise a cap or other suitable means for rotating the outer sleeve which, in turn, rotates the inner sleeve by way of the aforementioned torque transmitting means. The first component preferably further comprises a friction clutch which is interposed between the cap and the outer sleeve and allows the cap to turn relative to the outer sleeve when the latter offers excessive resistance to rotation with the cap. The aforementioned end wall of the outer sleeve can be provided with an annulus of closely adjacent depressions and the friction clutch then comprises at least one protuberance provided at the inner side of an end wall of the cap and extending into one of the depressions. When the outer sleeve offers excessive resistance to rotation with the cap, the protuberance or protuberances of the cap simply ride over the ridges between neighboring depressions at the outer side of the end wall which forms part of the outer sleeve.

The means for releasably coupling the cap to the outer sleeve preferably comprises a shoulder (e.g., a circumferentially complete shoulder) at the exterior of the outer cylindrical wall of the outer sleeve and an inwardly extending collar which is provided on a circumferentially extending cylindrical wall of the cap and engages the shoulder of the outer sleeve to prevent separation of the cap from the outer sleeve, as considered in the axial direction of the shaft at the rear side of the stop. The cap is preferably made of a single piece of suitable synthetic plastic material.

The novel features which are considered as characteristic of the invention are set forth in particular in the appended claims. The improved adjusting means itself, however, both as to its construction and its mode of operation, together with additional features and advantages of the appliance, will be best understood upon perusal of the following detailed description of certain specific embodiments with reference to the accompanying drawing.

BRIEF DESCRIPTION OF THE DRAWING

FIG. 11 is an axial sectional view of the outer sleeve of the first component of the adjusting means;

FIG. 12 is an end elevational view of the outer sleeve as seen from the left-hand side of FIG. 11;

FIG. 13 is a fragmentary end elevational view of the outer sleeve as seen from the right-hand side of FIG. 11;

FIG. 14 is a developed view of a portion of the outer sleeve;

FIG. 15 is an axial sectional view of a cap which forms part of the first component of the adjusting means and can be used as a means for rotating the sleeves about their common axis;

FIG. 16 is an end elevational view of the cap as seen from the left-hand side of FIG. 15;

DESCRIPTION OF THE PREFERRED EMBODIMENTS

Figure 1:
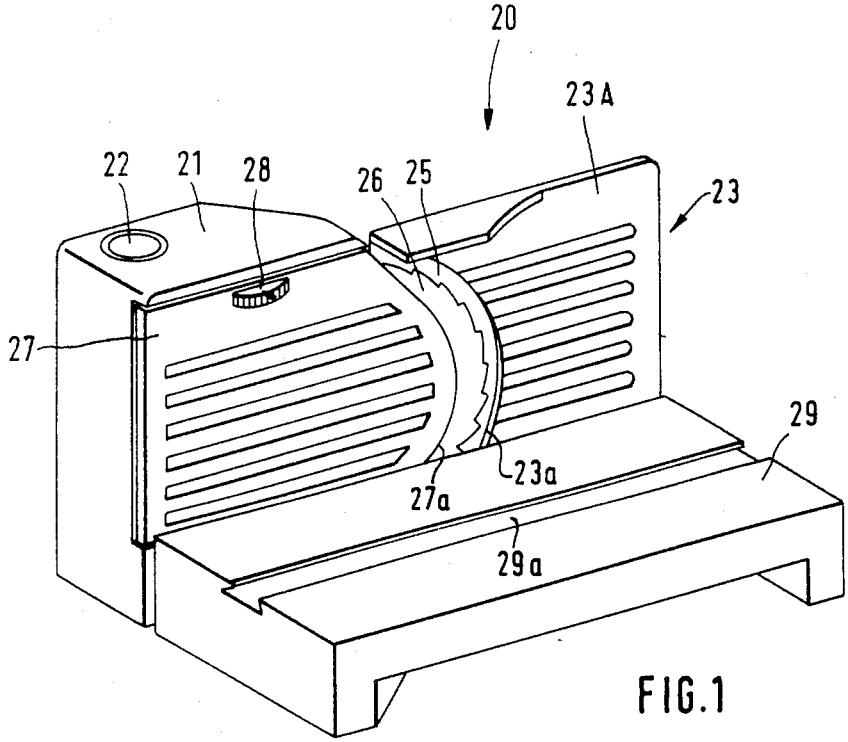
FIG. 1 is a schematic perspective front elevational view of an appliance which constitutes a household slicing machine and embodies the present invention, a portion of the knife being exposed so that the appliance is ready for use.

The drawing shows only those parts of the improved appliance 20 which are necessary for full understanding of the invention. Certain other details of the improved appliance are described and shown in the aforementioned commonly owned copending patent application Ser. Nos. 665,128 and 665,017 of Flammann (for "Household appliance with an adjustable guard for a rotary tool") and Flammann et al. (for "Household appliance and an adjustable guard for its tool").

Figure 2:
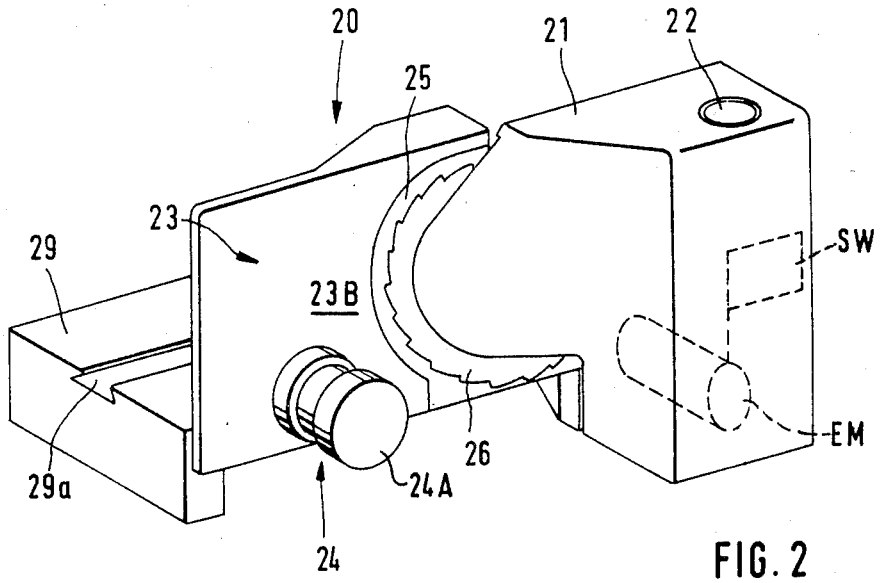
FIG. 2 is a schematic perspective rear elevational view of the appliance, showing the location of the first component of the adjusting means at the rear side of the stop.

The appliance 20 which is shown in FIGS. 1 and 2 comprises a housing or support 21 containing an electric motor EM and a switch SW which is in circuit with the motor and can complete such circuit in response to depression of a reciprocable actuating member or trip 22 which is accessible at the top of the housing 21. The housing 21 preferably further contains a variable-speed transmission (not specifically shown) which can transmit torque from the output element of the motor EM to the shaft of a disc-shaped rotary knife 26. The transmission can be adjusted to vary the speed of the knife 26, and the latter is located in a vertical plane and is partially overlapped by an adjustable plate-like one-piece protective shroud or guard 27 which is shiftable relative to the housing 21 in a second vertical plane parallel to the plane of the knife 26. The reference character 28 denotes a handgrip portion which is provided on the guard 27 to facilitate its shifting to a selected position with reference to the housing 21 and knife 26. For example, the guard 27 can be moved to and from the position which is shown in FIG. 1 and in which its convex edge face 27*a* cooperates with the concave edge face 23*a* of a plate-like stop 23 to define an arcuate sickle-shaped slot 25 for the passage of successive slices from the front side toward the rear side of the appliance 20, i.e., successive slices emerge at that side of the appliance which is shown in FIG. 2. The guard 27 is further movable to a second position in which the convex edge face 27*a* is closely adjacent to or actually contacts the concave edge face 23*a* to prevent access to the knife 26 from the front side of the appliance 20, i.e., to reduce the width of the slot 25 to or close to zero.

Still further, the guard 27 is preferably movable to a third position (to the left of the position which is shown in FIG. 1) in which it can be detached from the adjacent front wall of the housing 21. The guard 27 can further serve to prevent depression of the trip 22 (i.e., to prevent completion of the circuit of the motor EM for the knife 26) except when it assumes the position of FIG. 1. All this is fully described in the aforementioned copending applications Ser. Nos. 665,128 and 665,017 of Flammann and Flammann et al.

FIGS. 1 and 2 further show a bridge-like working platform 29 which can constitute a separable or an integral part of the housing or support 21 and whose top surface has an elongated dovetailed groove 29*a* for a reciprocable holder or carriage (not shown) which can be used to facilitate the manipulation of a foodstuff to be sliced, for example, to facilitate the manipulation of small end pieces of sausages, loaves of bread or the like. Other types of attachments can be movably mounted on the working platform 29 and used in the improved applicance 20 with equal or similar advantage.

The stop 23 is a substantially plate-like part which is preferably disposed in a vertical plane parallel to the plane of the knife 26 and the entire stop is movable relative to the knife (at right angles to the plane of the knife while its orientation remains unchanged) in order to select the thickness of the slices which can be severed from a foodstuff that abuts against the front side or surface 23A of the stop 23 and is caused to move along the top surface of the platform 29 (i.e., in the longitudinal direction of the groove 29*a*) toward and along the guard 27. The adjusting device 24 which serves to move the stop 23 relative to the plane of the knife 26 is constructed and assembled in accordance with the present invention and comprises two main components, namely a rotatable first component 24A which is detachably mounted at the rear side 23B of the stop 23 and a stationary second component 24B which is removably mounted in the working platform 29. The knife 26 is also separable from the housing 21 for more convenient cleaning, inspection and (when necessary) replacement. For example, the knife 26 can be readily detached from its shaft (or with its shaft) when the guard 27 is removed from the housing 21. Such removal can take place when the guard 27 is moved to the aforementioned third position to the left of the position which is shown in FIG. 1.

Figure 3:
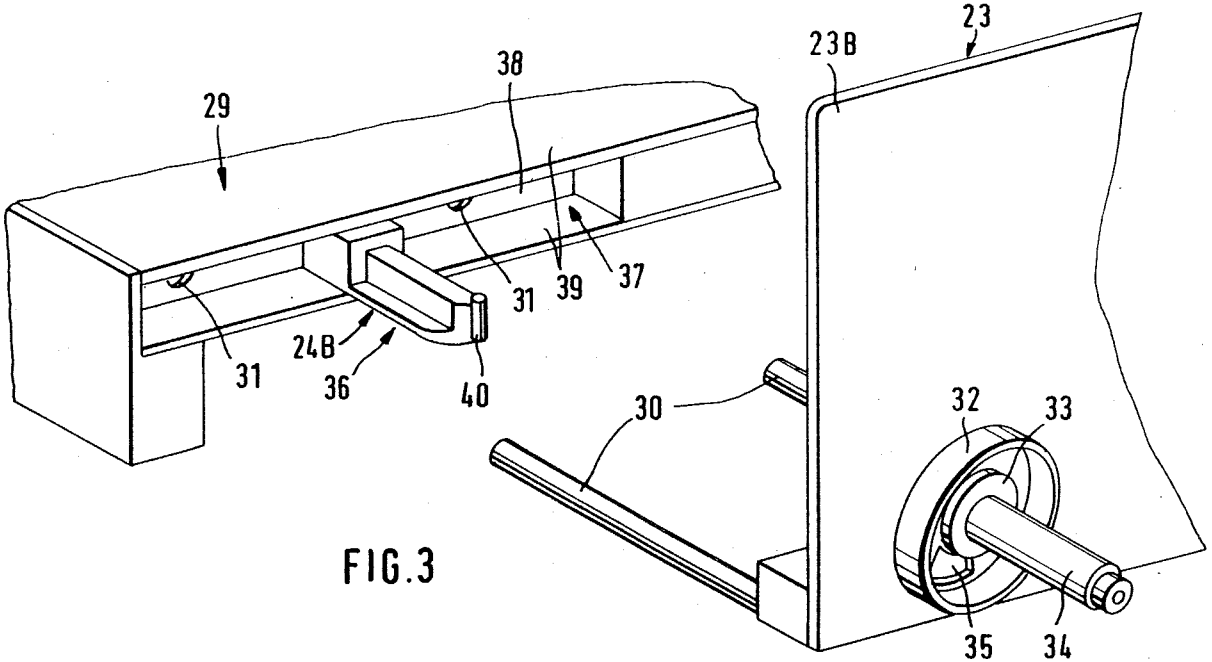
FIG. 3 is an enlarged fragmentary exploded perspective view of the stop and of a working platform which forms part of the support, the second component of the adjusting means being shown in installed position and the first component of the adjusting means being omitted in order to show those parts of the stop which carry the second component.

When the appliance 20 is fully assembled, the bridge-like working platform 29 is preferably rigidly affixed to the remaining part or parts of the housing 21. However, it is also possible to mount the platform 29 for pivotal movement relative to the remaining part or parts of the housing 21 so that the appliance 20 can be converted into a relatively small package for storage or shipment. The working platform 29 further constitutes a means for guiding the stop 23 in its movements relative to the knife 26 for the purpose of changing the distance between the plane of the front side 23A of the stop and the plane of the circumferentially complete serrated cutting edge of the knife 26. As can be seen in FIG. 3, that side of the working platform 29 which faces the front side 23A of the stop 23 has an elongated recess 37 which is flanked from above and from below by two parallel horizontal sidewalls 39 and at the rear by a bottom wall 38 which is located in a vertical plane. The bottom wall 38 has several openings in the form of circular holes 31 two of which receive portions of two elongated rod-shaped guides 30 affixed to or integral with the lower portion of the stop 23 at a level below that part of the front side 23A which is contacted by foodstuffs when the appliance 20 is in actual use. The walls 38 and 39 constitute a substantially U-shaped enclosure surrounding the recess 37 and receiving a portion of the second component 24B of the adjusting device 24.

Figure 17:
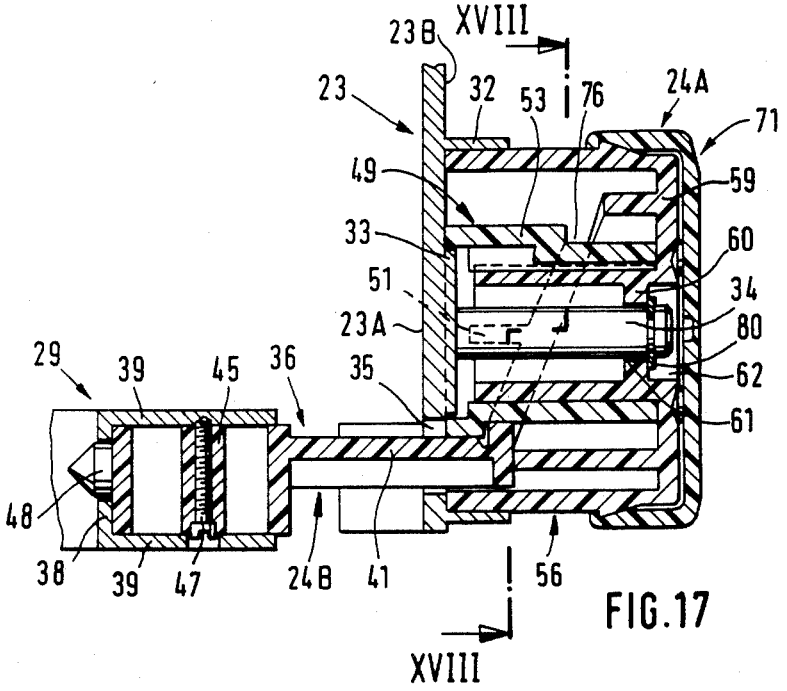
FIG. 17 is a sectional view of the assembled adjusting means and of portions of the support and stop.

The stop 23 has a horizontal stub shaft 34 which is disposed between and is parallel with the guides 30. The shaft 34 extends from the rear side 23B of the stop 23 and is spacedly surrounded by a rather short cylindrical receptacle 32 for the separable first component 24A of the adjusting device 24. As can be seen in FIG. 17, the receptacle 32 constitutes an integral part of the stop 23 and spacedly surrounds a washer-like centering member 33 which is also integral with the stop 23 and surrounds the adjacent portion of the shaft 34. The stop 23 has an arcuate opening or window 35 which is disposed at a level below the shaft 34 between the receptacle 32 and the centering member 33 and permits for insertion of a portion of the second component 24B through the stop and into the interior of the first component 24A.

Figure 4:
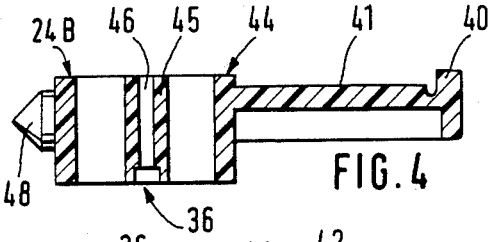
FIG. 4 is a central longitudinal sectional view of the second component of the adjusting means.
Figure 5:
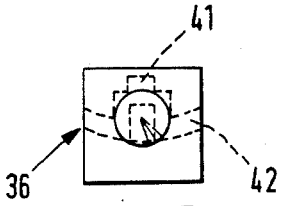
FIG. 5 is an end elevational view of the second component as seen from the left-hand side of FIG. 4.
Figure 6:
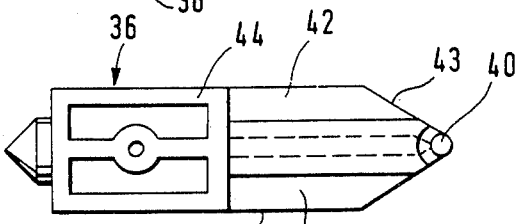
FIG. 6 is a plan view of the second component which is shown in FIGS. 4 and 5.
Figure 9:
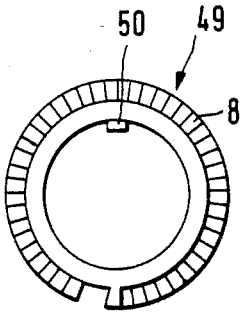
FIG. 9 is an end elevational view of the inner sleeve as seen from the right-hand side of FIG. 7.
Figure 7:
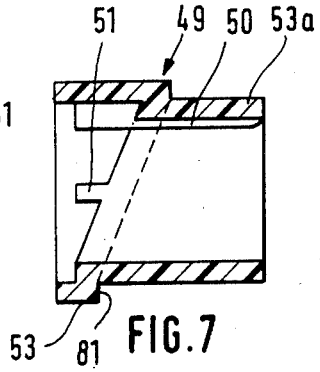
FIG. 7 is an axial sectional view of the inner sleeve of the first component of the adjusting means.
Figure 8:
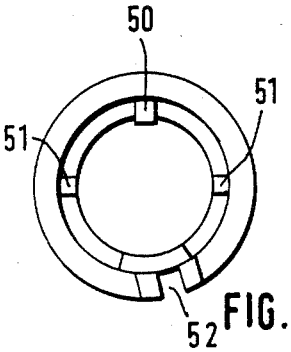
FIG. 8 is an end elevational view of the inner sleeve as seen from the left-hand side of FIG. 7.

The component 24B of the adjusting device 24 has an elongated one-piece holder or carrier 36 for a vertical stud-like follower 40. As can be seen in FIGS. 4 to 6, the follower 40 is integral with the carrier 36. The entire second component 24B can be made from a suitable synthetic plastic material such as DELRIN (trademark). The follower 40 has a circular cross-sectional outline (see FIGS. 3 and 6). The first or front portion 41 of the carrier 36 is integral with the follower 40 and its central part is provided with two laterally extending wings 42 having arcuate cross-sectional outlines (see particularly FIGS. 5 and 18). The front edge faces 43 of the wings 42 taper forwardly toward the follower 40. The lateral edge faces **42*a* of the two wings 42** are parallel to each other.

The enlarged rear or second portion 44 of the carrier 36 may but need not constitute a solid body. In the illustrated embodiment, the rear portion 44 is hollow and is formed with a longitudinally extending vertical partition 45 defining a vertical hole 46 for a screw 47 (shown in FIG. 17) which serves to secure the carrier 36 to one sidewall 39 of the working platform 29 in a manner as shown in FIG. 3, i.e., so that the second component 24B is located substantially midway between the rod-shaped guides 30 of the stop 23. The screw 47 preferably meshes with the lower sidewall 39. That end wall of the enlarged rear portion 44 of the carrier 36 which is remotest from the front portion 41 has an outwardly extending locating stud 48 serving to enter a third opening or hole (not shown) in the bottom wall 38 of the working platform 29 to reliably hold the entire second component 24B in the recess 37. The aforementioned third hole or opening is located substantially or exactly midway between the two openings 31 which are actually shown in FIG. 3. The configuration of the rear portion 44 is such that it cannot rotate in the recess 37, and the stud 48 cooperates with the bottom wall 38 to prevent any shifting of the carrier 36 in the longitudinal direction of the recess 37. Due to such configuration of the portion 44 and due to the provision of the stud 48 thereon, a single screw 47 or another suitable fastener suffices to reliably hold the second component 24B in an optimum position with reference to the working platform 29. The pointed tip at the free end of the stud 48 facilitates its insertion into the corresponding opening of the bottom wall 38.

Figure 18:
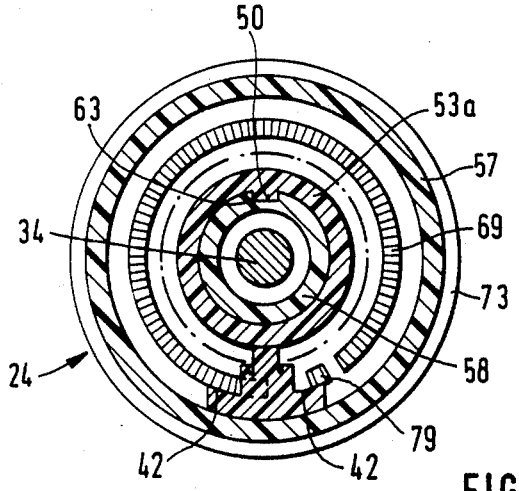
FIG. 18 is a sectional view as seen in the direction of arrows from the line XVIII—XVIII of FIG. 17.

The first component 24A of the adjusting device 24 comprises a cylindrical inner sleeve 49 which is shown in detail in FIGS. 7 to 10 as well as in FIGS. 17 and 18. The entire inner sleeve 49 is preferably made from a single piece of suitable synthetic plastic material, e.g., NOVODUR (trademark), and includes two cylindrical walls 53 and **53*a* having different outer and inner diameters. The axial length of the walls 53 and 53*a* varies, as considered in the circumferential direction of the inner sleeve 49, and the larger-diameter wall 53 has a serrated (e.g., toothed) helical surface 81 at the adjacent end of the smaller-diameter wall 53*a*. The internal surface of the inner sleeve 49 is formed with an axially parallel projection or tongue in the form of an elongated rib 50 extending substantially all the way between the two end faces of the inner sleeve (see particularly FIG. 7). The rib 50 constitutes a means for receiving torque from a second or outer sleeve 56 of the first component 24A**.

Figure 10:
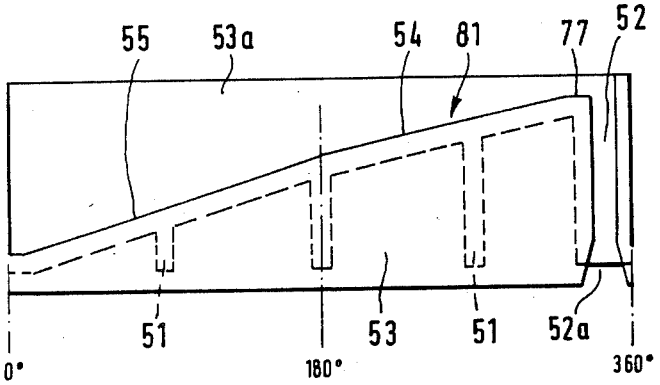
FIG. 10 is a developed view of the inner sleeve.

As can be seen in FIG. 10, the slope or inclination of the helical surface 81 of the cylindrical wall 53 is not constant. Thus, the surface 81 includes a section 54 of lesser inclination and an immediately adjacent section 55 of greater inclination. Still further, the surface 81 has a relatively short section 77 whose inclination is zero, i.e., whose distance from either axial end of the inner sleeve 49 is constant. The reference character 52 denotes an axially parallel channel which is machined into or otherwise formed in the cylindrical wall 53 and terminates at the section 77 of the helical surface 81. The inlet **52*a* of the channel 52 tapers in a manner as shown in FIG. 10 in order to allow for more convenient introduction of a portion of the follower 40. The inner side of the cylindrical wall 53 is further formed with three equidistant centering projections in the form of axially parallel ribs 51 which engage the peripheral surface of and center the inner sleeve 49 on the shaft 34 when the first component 24A is properly mounted at the rear side 23B of the stop 23. The number of centering ribs 51 can be reduced to two or increased to four or more, and such ribs need not be equidistant from one another, as considered in the circumferential direction of the wall 53. The length of the illustrated ribs 51 is not uniform but all of these ribs terminate at the same distance from the open end of the cylindrical wall 53. This provides room for the aforementioned washer-like centering member 33 at the rear side 23B of the stop 23 when the inner sleeve 49 is properly mounted on the shaft 34 and its left-hand end face (as viewed in FIG. 7 or 17) abuts against the rear side 23B immediately adjacent to the periphery of the centering member 33**.

The details of the outer sleeve 56 of the first component 24A are shown in FIGS. 11 to 14 and also in FIGS. 17 and 18. This outer sleeve is preferably a one-piece body made of a suitable synthetic plastic material (e.g., the same as the material of the inner sleeve 46).

The outer sleeve 56 comprises a cylindrical outer wall 57, a cylindrical inner wall 58 which is coaxial with and is spaced apart from the outer wall 57, and a cylindrical intermediate wall 64 which is spaced apart from the walls 57 and 58. The right-hand end portions of the walls 57, 58 and 64 (as viewed in FIG. 11) are integral with a disc-shaped end wall 59 and the peripheral surface of the outer cylindrical wall 57 is formed with a circumferentially complete annular external shoulder 68 which can be engaged by the inwardly extending collar 73 of a snap-on cap 71 shown in FIGS. 15 and 16 and serving to rotate the sleeves 46 and 56 when the operator wishes to change the distance between the plane of the front side 23A of the stop 23 and the plane of the knife 26. The intermediate wall 64 has a serrated helical surface 69 which is located opposite the helical surface 81 of the cylindrical wall 53 when the sleeves 49 and 56 are properly assembled with each other and with the shaft 34 so that the helical surfaces 69 and 81 then define a helical path 76 including three arcuate sections each of which has a different lead. As can be seen in FIG. 14, the helical surface 69 includes a first section 65 having a first inclination, a second section 66 having a more pronounced second inclination and a third section 79 whose inclination is zero, i.e., whose distance from the end wall 59 of the outer sleeves 56 is constant. The reference character 67 denotes in FIG. 14 the locus or junction where the sections 65 and 66 of the helical surface 69 meet. The length of each of the sections 65, 66 approximates 180 degrees, as considered in the circumferential direction of the intermediate wall 64, and the same preferably applies for the sections 54, 55 of the helical surface 81 on the cylindrical wall 53 of the inner sleeve 49. The sections 77 and 78 are located opposite each other adjacent to the channel 52 and define a path section whose lead is zero, i.e., the distance between the plane of the front side 23A of the stop 23 and the plane of the knife 26 does not change when the sleeves 49, 56 are rotated by the cap 71 while the follower 40 is located between the sections 77 and 78 of the helical surfaces 81 and 69.

The central portion 60 of the end wall 59 of the outer sleeve 56 is recessed and has a centrally located hole 61 for a portion of the shaft 34. The central portion 60 defines in the outer side of the end wall 59 a recess or pocket 62 which can receive a retaining device 80 (FIG. 17) serving as a means for holding the sleeves 49 and 56 against axial movement with reference to the shaft 34. The illustrated retaining device 80 is or can constitute a split ring which is inserted into a circumferential groove of the shaft 34 at such a distance from the rear side 23B of the stop 23 that the free end faces of the cylindrical walls 53, 57 abut against the outer side 23B and the free end face of the cylindrical wall 58 abuts against the centering member 33 when the first component 24A is properly mounted on the stop 23.

When the appliance 20 is in actual use, the pressure which a loaf of bread or the like transmits to the front side 23A of the stop 23 is transmitted to the inner sleeve 49 which bears against the inner side of the end wall 59 of the outer sleeve 56. The two sleeves are thus held against axial movement relative to each other, and the split ring 80 ensures that the outer sleeve 56 cannot move axially relative to the shaft 34. The tongue or rib 50 of the inner sleeve 49 extends into an axially parallel external groove 63 of the inner cylindrical wall 58 of the outer sleeve 56 whereby the surface which surrounds the groove 63 serves as a means for transmitting torque to the inner sleeve 49 when the operator decides to turn the cap 71 in a clockwise or in a counterclockwise direction, i.e., the sleeves 49 and 56 of the properly assembled first component 24A invariably rotate as a unit.

The intermediate cylindrical wall 64 of the outer sleeve 56 is formed with a substantially axially parallel slot or cutout 179 which extends all the way to the inner side of the end wall 59 (see FIGS. 12 and 14) and contains a relatively small projection or detent 79 which can engage the follower 40 when the latter is disposed in the aofrementioned helical path 76 between the helical surfaces 81 and 69. The person rotating the knob 71 notices that the resistance to turning of the knob 71 increases and such person is thereby informed that the follower 40 is located at the one or the other end of the helical path 76 which is defined by the cylindrical walls 53 and 64. Moreover, the person turning the knob 71 is informed that the projection 79 must move over the follower 40 before the latter registers with the adjacent end of the channel 52 and can be extracted from the first component 24A. In other words, the stop 23 can be separated from the working platform 29 when the projection 79 has been moved over the stationary follower 40 so that the latter is in register with the channel 52 in the cylindrical wall 53 of the inner sleeve 49.

FIGS. 11 and 13 show that the outer side of the end wall 59 of the outer sleeve 56 has an annulus of closely adjacent circular depressions 70 which surround the pocket 62 and are disposed at the same radial distance from the axis of the outer sleeve 56 as the complementary protuberances 75 at the inner side of the top wall or end wall 74 of the cup-shaped snap-on cap 71. The latter is shown in detail in FIGS. 15 and 16. The surfaces surrounding the depressions 70 in the outer side of the end wall 59 constitute one element of a friction clutch the other component of which are the protuberances 75 of the cap 71. The latter is preferably made of a single piece of suitable synthetic plastic material (e.g., the material of the inner sleeve 49 and/or outer sleeve 56) and comprises a circumferentially extending cylindrical wall 72 extending from the inner side of the bottom wall 74 and carrying at its free end the aforementioned collar 73 which can releasably engage the external shoulder 68 of the cylindrical wall 57 of the outer sleeve 56. At such time, the protuberances 75 extend into the adjacent depressions 70 and thus ensure that the outer sleeve 56 normally rotates about the axis of the shaft 34 in response to rotation of the cap 71. However, if the outer sleeve 56 offers a predetermined maximum permissible resistance to rotation, the cap 71 begins to turn relative to the end wall 59 and the probuterances 75 simply ride over the ridges between the closely adjacent neighboring depressions 70. The provision of the just discussed friction clutch is desirable and advantageous because the clutch reduces the likelihood of damage to the first component 24A when the stop 23 reaches a selected end position and should not move further away from or nearer to the plane of the knife 26, depending upon the end position of the stop. It has been found that four equidistant protuberances 75 normally suffice to ensure proper functioning of the friction clutch.

The sections 54 and 65 of the surfaces 81 and 69 define a first section of the aforementioned helical path 76, and the lead of this section is less pronounced than the lead of the path section between the sections 55 and 66. The follower 40 preferably extends into the path section between the surfaces 54, 65 when the plane of the front side 23A of the stop 23 is rather close to the plane of the knife 26 so that the operator can select the thickness of relatively thin slices with a much higher degree of accuracy than the thickness of the relatively thick slices. For example, the follower 40 will be located between the surface sections 55, 66 when the operator wishes to slice a loaf of bread because the exact thickness of a slice of bread is normally immaterial. On the other hand, if the user wishes to make very thin slices of salami or smoked ham, exact selection of the thickness of each slice is much more important or desirable.

FIGS. 17 and 18 show a portion of the stop 23, a portion of the working platform 29, and the components 24A, 24B of the adjusting device 24 in fully assembled condition. The free end face of the outer cylindrical wall 57 of the outer sleeve 56 abuts against the rear side 23B of the stop 23 and this wall 57 is immediately adjacent to the inner side of the receptacle 32. The shaft 34 extends through the central opening 61 in the recessed portion 60 of the end wall 59 of the outer sleeve 56 and its circumferential groove receives the split ring 80 to hold the sleeves 49 and 56 against axial movement away from the stop 23. The free end of the shaft 34 is located in the pocket 62 so that the shaft does not interfere with the attachment of the cap 71 to the outer sleeve 56. The rib 50 of the inner sleeve 49 extends into the groove 63 of the inner cylindrical wall 58 so that the sleeves 49 and 56 are compelled to rotate as a unit as soon and as long as the user turns the cap 71.

The wall 53 of the inner sleeve 49 surrounds the centering member 33 which thereby centers the inner sleeve 49 with reference to the shaft 34, and the free end face of the cylindrical wall 53 abuts against the rear side 23B of the stop 23. The free end face of the cylindrical wall 53*a* of the inner sleeve 49 abuts against the inner side of the end wall 59 of the outer sleeve 56. The helical surfaces 81 and 69 of the walls 53 and 64 define the aforementioned helical path 76 for the follower 40 on the carrier 36 which latter is affixed to the working platform 29 in a manner as described in connection with FIG. 3. The arcuate wings 42 of the front portion 41 of the carrier 36 are received between the cylindrical walls 57 and 64 of the outer sleeve 56. The curvature of these wings matches that of the adjacent surfaces of the cylindrical walls 57 and 64. The upper side of the front portion 41, as viewed in FIG. 17, abuts against the external surface of the wall 53 of the inner sleeve 49. Such dimensioning of the front portion 41 ensures proper guidance of the sleeves 49 and 56 when they are caused to turn with the cap 71.

The channel 52 in the wall 53 is preferably moved into register with the follower 70 in the zero angular position of the inner sleeve 49, e.g., in that angular position when the stop 23 is located in the one or the other end position. The stop 23 is then free to move in a direction away from the working platform 29 and can be fully detached from other parts of the appliance 20, e.g., for the purposes of cleaning. The rod-shaped guides 30 of the stop 23 then simply slide in the respective holes 31 of the bottom wall 38 and the window 35 of the stop 23 moves relative to the second component 24B which latter remains attached to the platform 29. Reassembly of the stop 23 with the working platform 29, and hence a reengagement of the first component 24A with the second component 24B, is effected by reversing the just described sequence of steps.

The improved appliance is susceptible of many additional modifications without departing from the spirit of the invention. For example, the configuration of the sleeves 49 and 56 can be varied as long as they can define a helical path for the follower 40, most preferably a helical path having sections with different leads to thus allow for highly accurate selection of the thickness of the slices during certain stages of rotation of the first component 24A relative to the second component 24B. Moreover, the component 24A can be mounted on the support of the appliance 20 and the component 24B is then mounted on the stop 23. The slope of the mutually inclined sections of the helical surfaces 81 and 69 can be changed within a wide range, depending upon the intended use of the appliance 20 and on the desired degree of accuracy with which the thickness of the slices is to be selected. Still further, the sections 54, 55, 77 of the helical surface 81 and the sections 65, 66, 79 of the helical surface 69 need not be straight. For example, the sections of the helical surface 81 can be slightly concave and the sections of the helical surface 69 can be slightly convex or vice versa. The number of mutually inclined sections on the helical surfaces 81 and 69 can be increased to four or more or reduced to a mere two. If one of the helical surfaces 81, 69 is concave and the other of these surfaces is convex, the arrangement is preferably such that the rearwardly facing surface 81 of the cylindrical wall 53 is convex.

The transition from helical surface sections of lesser inclination to helical surface sections of greater inclination should not be too pronounced because this could cause the follower 40 to jam at the locations (junctions) where such mutually inclined sections of the surfaces bounding the helical path 76 meet. An elongated cylindrical follower has been found to be ideally suited for use in the improved adjusting device.

The assembly of the first component 24A from two sleeve like parts 49 and 56 is desirable and advantageous because this simplifies the making of helical surfaces 81 and 69 which define the helical path 76. The length of various sections of the helical path 76 need not be the same. Such freedom in selecting the inclination and/or length of various sections of the helical surfaces 81 and 69 is available due to the fact that the sleeves 49 and 56 are two separately produced relatively simple parts which can be mass-produced in available plastic-processing machines and that their helical surfaces 81 and 69 are fully exposed prior to assembly into the first component 24A. Since the components 24A and 24B are readily detachable from the respective parts 29 and 23 of the appliance, the latter can be furnished with two or more adjusting devices 24 each of which allows for a different selction of the thickness of the slices which are formed by the knife 26. Also, the diameters of the followers 40 can vary from adjusting device to adjusting device if the appliance is furnished with two or more adjusting devices.

As mentioned above, the sections 54, 55 and 65, 66 of the respective helical surfaces 81 and 69 can extend along arcs of approximately 180 degrees, as considered in the circumferential direction of the respective sleeves 49 and 56. The section which defines the path section of lesser lead is preferably adjacent to that portion of the helical path 76 in which the follower 40 is located when the distance between the plane of the front side 23A of the stop 23 and the plane of the normally thin or extremely thin knife 26 is zero or close to zero. This ensures that the thicknes of the relatively thin slices can be selected with a higher degree of accuracy than the thickness of the relatively thick slices. The user of the appliance 20 learns quickly that the first half revolution of the cap 71 from the zero position of the first component 24A precedes the making of thin slices whose thickness can be selected with a very high degree of accuracy because the cap 71 must be turned through a relatively large angle in order to effect a small or extremely small change in the distance between the plane of the front side 23A of the stop 23 and the plane of the knife 26, and that the second half of the revolution of the cap 71 from zero position involves preparation of the appliance for the making of relatively thick slices.

The provision of the channel 52 is desirable and advantageous because it allows for convenient separation of the stop 23 from other parts of the appliance for the purposes of inspection, cleaning or storage. The provision of the projection 79 in the slot 179 of the cylindrical wall 64 is desirable and advantageous because this projection can be provided at a location such that it moves into engagement with the follower 40 when the distance between the plane of the front side 23A and the plane of the knife 26 is at a minimum or zero. This warns the operator that the first component 24A has been moved close to an angular position in which the stop 23 can be separated from the platform 29. All that is necessary is to cause the projection 79 to move over the follower 40 whereby the channel 52 registers with the follower and the stop 23 can be detached from the platform 29.

The component 24A of the adjusting device 24 can be furnished with a single outer sleeve 56 and with two or more inner sleeves 49 having different axial lengths or vice versa. This renders it possible to change the width of the helical path 76 in order to allow for use of two or more components 24B with followers 40 having different diameters.

The provision of tapering edge faces 43 on the wings 42 of the front portion 41 of the carrier 36 facilitates insertion of this carrier into the first component 24A, and the aforediscussed curvature of the wings 42 enables them to adequately guide the outer sleeve 56 during rotation with reference to the carrier 36. The cost of the second component 24B is low because it is preferably made of a single piece of suitable synthetic plastic material.

An important advantage of the friction clutch including the protuberances 75 of the cap 71 is that it greatly reduces the likelihood of damage to the adjusting device 24 when the user wishes to turn the sleeves 49, 56 beyond the one or the other end position, i.e., when the front side 23A of the stop 23 is located at a maximum distance from the plane of the knife 26 or in the other end position. The wall 72 of the cap 71 surrounds a major part of the exposed portion of the outer sleeve 56 so that it is invariably gripped by the person who wishes to rotate the sleeves 49, 56 in a clockwise or in a counterclockwise direction. This ensures that the friction clutch including the protuberances 75 becomes effective whenever the need for such friction clutch arises. This, in turn, ensures that the user cannot apply to the sleeves 49, 56 of the component 24A (and hence to the component 24B) any forces which could result in damage to or in complete destruction of the adjusting device 24. The exact magnitude of forces which are needed to turn the cap 71 relative to the outer sleeve 56 can be selected by the manufacturer in dependency on the dimensions, material and other characteristics of the parts of the adjusting device 24.

It is clear that the illustrated friction clutch is but one of many types of friction clutches which can be used in the improved adjusting device. The illustrated friction clutch is preferred at this time due to its simplicity because its parts can be formed simultaneously with the making of the outer sleeve 56 and cap 71. The same holds true for the means (shoulder 68 and collar 73) for releasably coupling the cap 71 to the outer sleeve 56, i.e., the shoulder 68 and the collar 73 can be formed simultaneoulsy with the making of the respective parts 56, 71 in a suitable plastic processing machine of any known design.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An appliance, particularly a household slicing machine, comprising a support; a knife mounted in said support for rotation in a first plane; a stop for the material to be sliced, said stop being located in a second plane which is at least substantially parallel to said first plane; and adjusting means mounted in part on said support and in part on said stop and arranged to move said stop in a direction transversely of said first plane, said adjusting means including a first component having two coaxial sleeves respectively having first and second cylindrical walls respectively having first and second helical surfaces defining a helical path and a second component including a follower extending into said path so that said stop is moved relative to said first plane when one of said components is rotated about the common axis of said sleeves.

2. The appliance of claim 1, wherein said stop includes a shaft and said sleeves are rotatably mounted on said shaft, said second component being stationary and being mounted in said support.

3. The appliance of claim 2, wherein said sleeves comprise an inner sleeve and an outer sleeve surrounding said inner sleeve, and further comprising retaining means for holding said sleeves against movement axially of said shaft.

4. The appliance of claim 3, further comprising means for rotating said outer sleeve and means for transmitting torque from said outer sleeve to said inner sleeve.

5. The appliance of claim 1, wherein said support comprises a working platform located in front of said stop and said second component is installed in said platform.

6. The appliance of claim 1, wherein said sleeves include a one-piece outer sleeve consisting of a synthetic plastic material and further including an outer cylindrical wall surrounding said second cylindrical wall and an inner cylindrical wall surrounded by said second cylindrical wall, said outer sleeve further comprising an end wall integral with said inner, outer and second cylindrical walls and having a centrally located opening, said stop including a shaft extending through said opening and further comprising retaining means provided on said shaft in the region of said opening to hold said outer sleeve against movement axially of said shaft in a direction away from said stop.

7. The appliance of claim 6, wherein said retaining means includes a split ring and said shaft has a peripheral groove for a portion of said split ring.

8. The appliance of claim 1, wherein said sleeves include a one-piece inner sleeve consisting of a synthetic plastic material and further including an additional cylindrical wall coaxial with and having an outer diameter different from the outer diameter of said first cylindrical wall.

9. The appliance of claim 8, wherein said first helical surface is adjacent to one axial end of said additional cylindrical wall.

10. The appliance of claim 1, further comprising means for rotating one of said sleeves and means for transmitting torque from said one sleeve to the other of said sleeves, said torque transmitting means including an axially parallel tongue provided on one of said sleeves and a groove provided in the other of said sleeves and receiving said tongue.

11. The appliance of claim 10, wherein said stop includes a shaft rotatably supporting said sleeves and said one sleeve includes means for centering said one sleeve on said shaft.

12. The appliance of claim 1, wherein said first cylindrical wall has an axially parallel channel for the passage of said follower, said channel communicating with a portion of said helical path so that, when said follower is located in said portion of said path, said components can be separated from each other by moving one of said components in the direction of the common axis of said components.

13. The appliance of claim 1, wherein said stop has a front side constituting an abutment for the material to be sliced and a rear side, said stop further including a shaft extending from said rear side and rotatably supporting said sleeves and a substantially ring-shaped receptacle provided at said rear side, said sleeves including an outer sleeve rotatably mounted in said receptacle and abutting against the rear side of said stop and an inner sleeve coaxial with and installed in said outer sleeve.

14. The appliance of claim 13, wherein said outer sleeve further comprises an outer cylindrical wall surrounding said second wall and being immediately adjacent to said receptacle, said stop further comprising a washer-like centering member provided at said rear side thereof and said first cylindrical wall having an open end receiving said washer-like member, said stop further having a window and said second component including a carrier supporting said follower and extending through said window.

15. The appliance of claim 14, wherein said receptacle spacedly surrounds said washer-like member and said window is located between said washer-like member and said receptacle, as considered in the radial direction of said shaft.

16. The appliance of claim 1, wherein said stop has a front side constituting an abutment for the material to be sliced and a rear side, said first component being provided at the rear side of said stop and said support including a working platform adjacent to the front side of said stop, said stop having a window and said second component including a carrier supporting said follower and extending through said window, said carrier being installed in said platform.

17. The appliance of claim 16, wherein said stop includes a plurality of elongated parallel guides extending from said front side thereof and said platform includes a wall having openings for said guides.

18. The appliance of claim 1, wherein said second component is a one-piece body consisting of a synthetic plastic material and including a carrier for said follower.

19. The appliance of claim 1, wherein said second component further comprises a carrier for said follower, said carrier including a first portion integral with said follower and a second portion removably installed in said support, said first portion being disposed between said follower and said second portion.

20. The appliance of claim 19, wherein the first portion of said carrier includes a central part and two wings extending laterally from the opposite sides of said central part and having front edge faces sloping toward said follower.

21. The appliance of claim 19, wherein said support has a recess for the second portion of said carrier and further comprising means for separably securing said second portion to said support.

22. The appliance of claim 21, wherein the second portion of said carrier includes a substantially centrally located partition having a hole and said securing means includes a threaded fastener having a portion received in said hole.

23. The appliance of claim 22, wherein said support includes a first wall which is connected with said second portion by means of said threaded fastener and a second wall adjacent to said first wall and having an opening, said second portion having a centering stud received in the opening of said second wall.

24. The appliance of claim 1, wherein said first component is rotatable with reference to said second component and further comprising means for rotating said sleeves and friction clutch means interposed between said rotating means and said sleeves.

25. The appliance of claim 24, wherein said sleeves include an inner sleeve having said first wall and an outer sleeve surrounding said inner sleeve and having said second wall, said rotating means comprising a cap provided on said outer sleeve and further comprising means for transmitting torque from said outer sleeve to said inner sleeve.

26. The appliance of claim 25, wherein said outer sleeve has a first end wall having an outer side and said cap includes a second end wall having an inner side adjacent to said outer side, said friction clutch including an annulus of depressions provided in one of said sides and at least one protuberance provided on the other of said sides and extending into one of said depressions.

27. The appliance of claim 26, wherein said depressions are provided in the outer side of said first end wall.

28. The appliance of claim 25, wherein said outer sleeve further includes an outer cylindrical wall spacedly surrounding said second cylindrical wall and having an external shoulder, said cap including a circumferentially extending wall surrounding said outer cylindrical wall and having an inwardly extending collar engaging said shoulder to prevent separation of said cap from said outer sleeve as considered in the axial direction of said sleeves.

29. The appliance of claim 28, wherein said shoulder is a circumferentially complete shoulder.

30. The appliance of claim 25, wherein said cap consists of a single piece of a synthetic plastic material.

* * * * *